US008444432B2

(12) United States Patent
Byrne et al.

(10) Patent No.: US 8,444,432 B2
(45) Date of Patent: May 21, 2013

(54) POWER AND DATA ADAPTER ASSEMBLY

(76) Inventors: Norman R. Byrne, Ada, MI (US); Daniel P. Byrne, Lowell, MI (US)

( * ) Notice: Subject to any disclaimer, the term of this patent is extended or adjusted under 35 U.S.C. 154(b) by 0 days.

(21) Appl. No.: 13/480,539

(22) Filed: May 25, 2012

(65) Prior Publication Data

US 2012/0231658 A1 Sep. 13, 2012

Related U.S. Application Data

(63) Continuation of application No. 12/816,051, filed on Jun. 15, 2010.

(60) Provisional application No. 61/268,703, filed on Jun. 15, 2009.

(51) Int. Cl.
*H01R 13/60* (2006.01)

(52) U.S. Cl.
USPC ..... 439/540.1

(58) Field of Classification Search
USPC ..... 439/540.1, 75
See application file for complete search history.

(56) References Cited

U.S. PATENT DOCUMENTS 3,049,688 A * 8/1962 Sinopoli ..... 439/41
3,433,886 A 3/1969 Myers
4,372,629 A 2/1983 Propst et al.
4,712,232 A 12/1987 Rodgers
4,773,867 A 9/1988 Keller et al.
4,984,982 A 1/1991 Brownlie et al.
5,087,207 A 2/1992 Byrne
5,092,786 A 3/1992 Juhlin et al.
5,092,787 A 3/1992 Wise et al.
5,096,431 A 3/1992 Byrne
5,122,069 A 6/1992 Brownlie et al.
5,125,852 A 6/1992 Archer
5,129,842 A 7/1992 Morgan et al.
5,161,997 A 11/1992 Defibaugh et al.
5,195,288 A 3/1993 Penczak
5,351,173 A 9/1994 Byrne
5,366,388 A 11/1994 Freeman et al.
5,575,668 A 11/1996 Timmerman
5,647,763 A 7/1997 Arnold et al.
5,651,696 A 7/1997 Jennison
D407,373 S 3/1999 Byrne
5,921,795 A 7/1999 Weener et al.
6,004,157 A * 12/1999 Glass ..... 439/574
6,015,305 A 1/2000 McHugh et al.
6,024,599 A 2/2000 Stathis et al.
6,028,267 A 2/2000 Byrne
6,042,426 A 3/2000 Byrne
6,234,812 B1 5/2001 Ivers et al.

(Continued)

OTHER PUBLICATIONS

Non-final Office Action dated Apr. 26, 2012 for co-pending U.S. Appl. No. 13/180,137, filed Jul. 11, 2011.

*Primary Examiner* — Amy Cohen Johnson
*Assistant Examiner* — Vladimir Imas
(74) *Attorney, Agent, or Firm* — Gardner, Linn, Burkhart & Flory, LLP

(57) ABSTRACT

A power and data adapter assembly includes an electrical receptacle assembly having a receptacle housing, removable side tabs and a simplex receptacle. The assembly also includes a data port assembly having the receptacle housing, data port adapter and data port connector. The data port assembly and simplex receptacle assembly are receivable within a channel support through ends of the channel support and are positionable in desired positions along the length of the channel support.

20 Claims, 12 Drawing Sheets

U.S. PATENT DOCUMENTS

| | | | | |
|---|---|---|---|---|
| 6,254,427 | B1 | 7/2001 | Stathis | |
| 6,290,518 | B1 | 9/2001 | Byrne | |
| 6,379,182 | B1 | 4/2002 | Byrne | |
| 6,384,336 | B1 | 5/2002 | VanderVelde et al. | |
| 6,420,964 | B1 | 7/2002 | Nishikawa et al. | |
| 6,435,461 | B1 | 8/2002 | Saylor et al. | |
| 6,497,586 | B1 | 12/2002 | Wilson | |
| 6,540,554 | B2 * | 4/2003 | McCarthy | 439/574 |
| 6,616,005 | B1 | 9/2003 | Pereira et al. | |
| 6,638,108 | B2 * | 10/2003 | Tachi | 439/595 |
| 6,793,524 | B2 | 9/2004 | Clark et al. | |
| 6,971,911 | B2 | 12/2005 | Ramsey et al. | |
| 6,974,911 | B2 | 12/2005 | Hyde | |
| 7,087,840 | B2 | 8/2006 | Herring et al. | |
| D535,257 | S | 1/2007 | Byrne | |
| 7,182,633 | B2 | 2/2007 | Byrne | |
| 7,244,128 | B2 | 7/2007 | Byrne | |
| 7,367,832 | B2 | 5/2008 | Muhs et al. | |
| 7,410,379 | B1 | 8/2008 | Byrne | |
| 7,448,875 | B2 | 11/2008 | Timmins et al. | |
| 7,481,680 | B2 | 1/2009 | Caveney et al. | |
| 7,488,202 | B2 | 2/2009 | Spitaels et al. | |
| 7,500,790 | B2 | 3/2009 | Erdman et al. | |
| 7,559,795 | B2 | 7/2009 | Byrne | |
| 7,682,187 | B2 | 3/2010 | Spitaels et al. | |
| 7,690,921 | B2 | 4/2010 | Timmins et al. | |
| 7,690,941 | B2 | 4/2010 | Caveney et al. | |
| 7,811,093 | B2 | 10/2010 | Timmins et al. | |
| 7,819,676 | B1 | 10/2010 | Cardoso et al. | |
| 7,881,462 | B2 | 2/2011 | Hazani et al. | |
| 2002/0142650 | A1 | 10/2002 | Clark et al. | |
| 2002/0187682 | A1 | 12/2002 | Lincoln et al. | |
| 2003/0091295 | A1 | 5/2003 | Cheng | |
| 2005/0159036 | A1 | 7/2005 | Caveney et al. | |
| 2006/0134971 | A1 | 6/2006 | Byrne | |
| 2006/0134998 | A1 | 6/2006 | Byrne | |
| 2006/0159399 | A1 | 7/2006 | Erdman et al. | |
| 2007/0004274 | A1 * | 1/2007 | Tabata et al. | 439/540.1 |
| 2007/0105432 | A1 | 5/2007 | Muhs et al. | |
| 2007/0149045 | A1 | 6/2007 | Caveney et al. | |
| 2008/0142504 | A1 | 6/2008 | Byrne | |
| 2008/0200050 | A1 | 8/2008 | Byrne | |
| 2008/0305679 | A1 | 12/2008 | Byrne | |
| 2009/0137159 | A1 | 5/2009 | Caveney et al. | |
| 2009/0142947 | A1 | 6/2009 | Byrne | |
| 2009/0301774 | A1 | 12/2009 | Byrne | |
| 2010/0317223 | A1 | 12/2010 | Byrne | |
| 2010/0322576 | A1 | 12/2010 | Rhoney et al. | |
| 2012/0009820 | A1 | 1/2012 | Byrne | |

* cited by examiner

POWER AND DATA ADAPTER ASSEMBLY

CROSS-REFERENCE TO RELATED APPLICATIONS

The present application is a continuation of U.S. patent application Ser. No. 12/816,051, filed Jun. 15, 2010, which claims priority of U.S. Provisional Application Ser. No. 61/268,703, filed Jun. 15, 2009.

FIELD OF THE INVENTION

The invention relates to power and data elements for use in power distribution systems, and, more particularly, the use of a channel element for purposes of receiving and supporting various ones of outlet receptacle housings, data port housings, communication port housings, and the like,

BACKGROUND OF THE INVENTION

With various types of power distribution assemblies, various numbers of electrical receptacles, data ports, communication ports, and other electronic elements may be utilized. It would be advantageous if there was commonality among the various types of electrical elements which may be utilized within a power distribution assembly. Further, it would be advantageous if these electrical elements could be readily reassembled in terms of configurations, and also utilize a means for receiving and supporting the electrical elements.

BRIEF DESCRIPTION OF THE DRAWINGS

The invention will now be described with respect to the drawings, in which.

DESCRIPTION OF THE PREFERRED EMBODIMENTS

FIGS. 1-8 illustrate various views of a simplex receptacle housing 100 in accordance with the invention.

Figure 1:
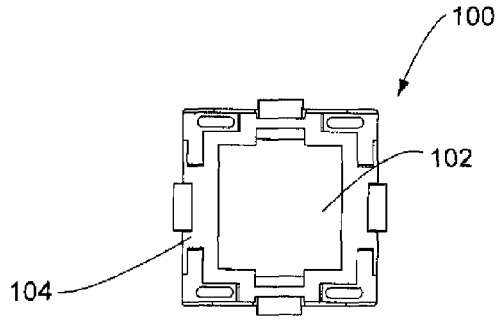
FIG. 1 is a rear view of a receptacle housing in accordance with the invention.
Figure 2:
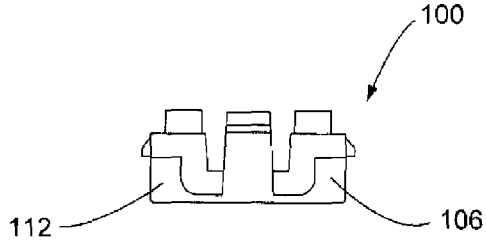
FIG. 2 is a plan view of the receptacle housing.
Figure 3:
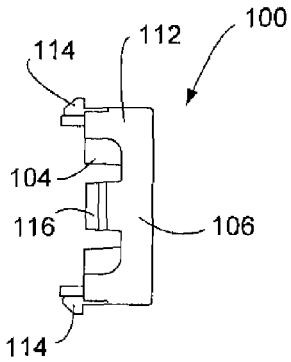
FIG. 3 is a left-side end view of the receptacle housing.
Figure 4:
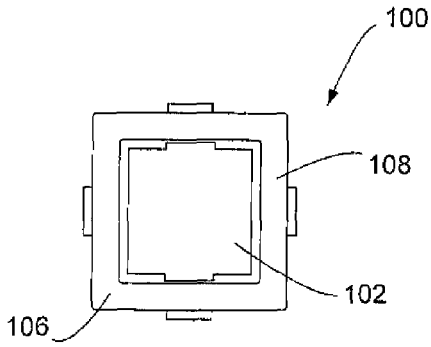
FIG. 4 is a front, elevation view of the receptacle housing.
Figure 5:
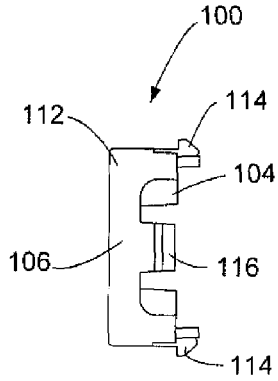
FIG. 5 is a right-side end view of the receptacle housing.
Figure 6:
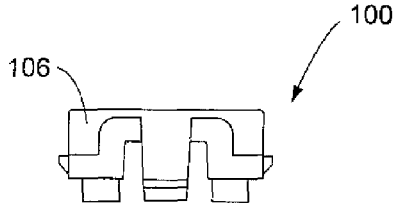
FIG. 6 is an underside view of the receptacle housing.

More specifically, FIG, 1 is a rear view of the receptacle housing. FIG. 2 is a plan view of the receptacle housing, while FIG. 3 is a left-side end view of the receptacle housing. FIG. 4 is a front, elevation view of the receptacle housing, while FIG. 5 is a right-side end view of the receptacle housing. FIG. 6 is an underside view of the receptacle housing.

Figure 7:
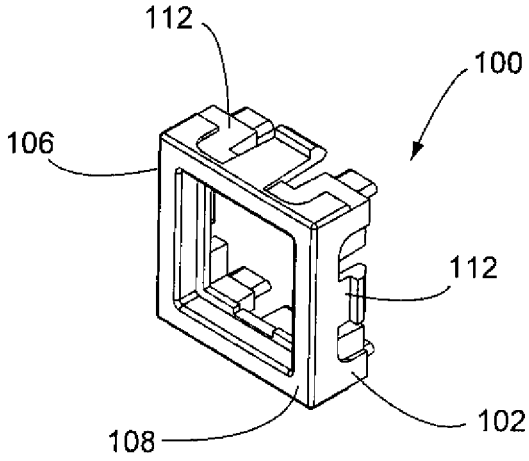
FIG. 7 is a front, perspective view of the receptacle housing.
Figure 8:
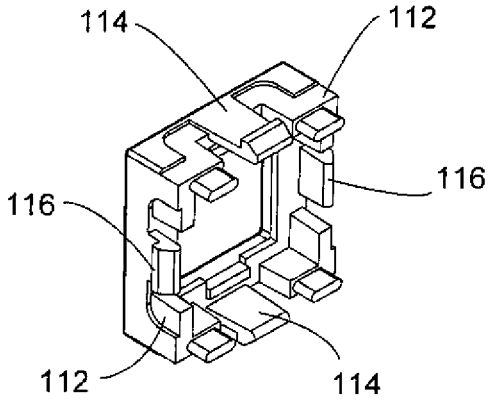
FIG. 8 is a rear, perspective view of the receptacle housing.

FIG. 7 is a front, perspective view of the receptacle housing. FIG, 8 is a rear, perspective view of the receptacle housing. With reference to these drawings, the receptacle housing 100 includes an opening 102 which is adapted to receive an outlet receptacle. The housing 100 includes a main body 104 with a front cover 106. The front cover 106 includes a face 108. The cover 106 also includes a set of sides 112. A pair of latch tabs 114 are positioned at upper and lower sides of the front cover 106. Side latch tabs 116 are positioned on opposing sides of the front cover 106.

FIGS. 9-16 illustrate a power and data channel support 120. Various views of the channel support 120 are shown in FIGS. 9-16.

Figure 9:
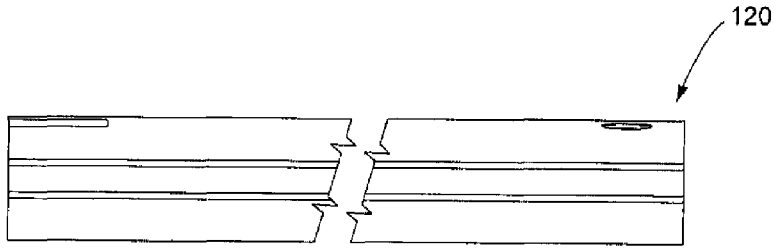
FIG. 9 is a rear, elevation view of a power and data channel support in accordance with the invention.
Figure 10:
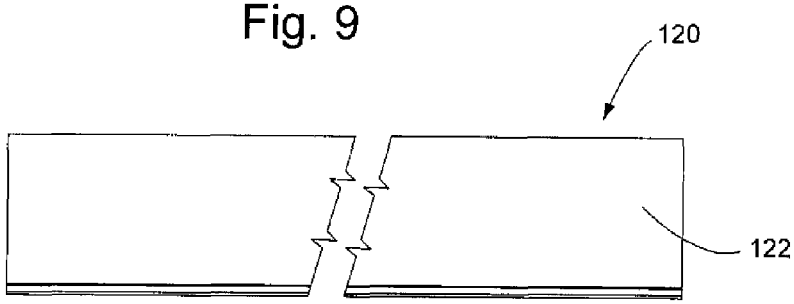
FIG. 10 is a plan view of the channel support shown in FIG. 9.
Figure 11:
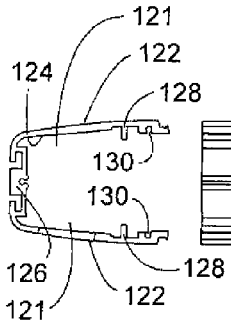
FIG. 11 is a left-side end view of the channel support.
Figure 12:
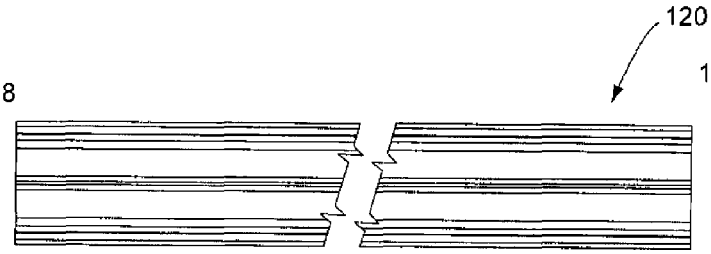
FIG. 12 is a front, elevation view of the channel support.
Figure 13:
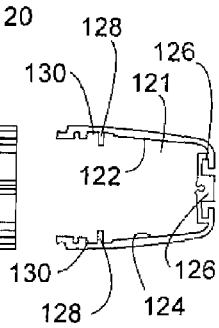
FIG. 13 is a right-side end view of the channel support.
Figure 14:
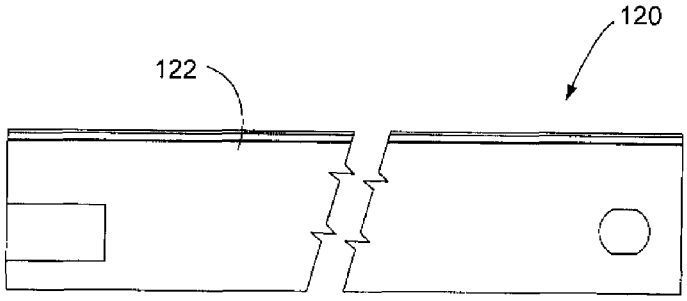
FIG. 14 is an underside view of the channel support.
Figure 15:
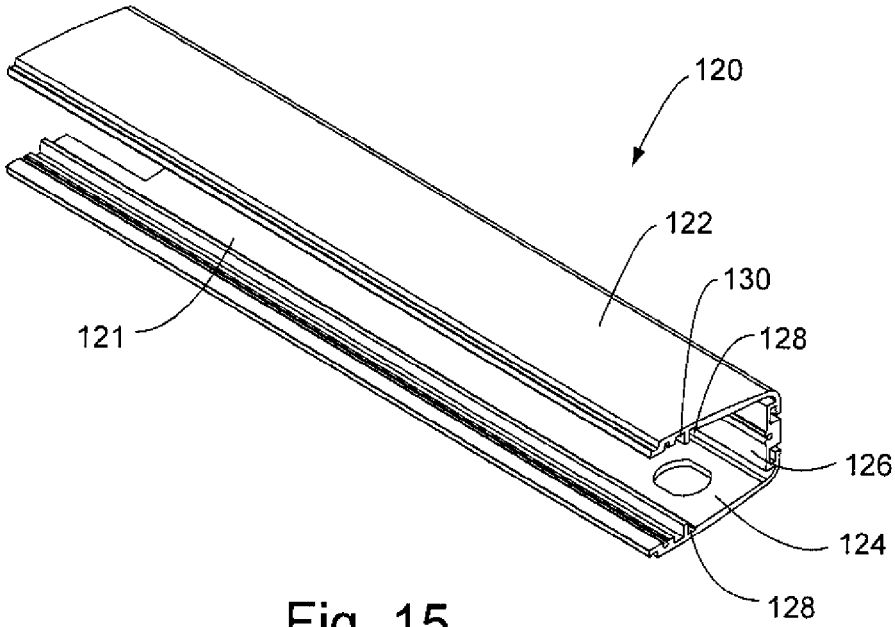
FIG. 15 is a front, perspective view of the channel support.
Figure 16:
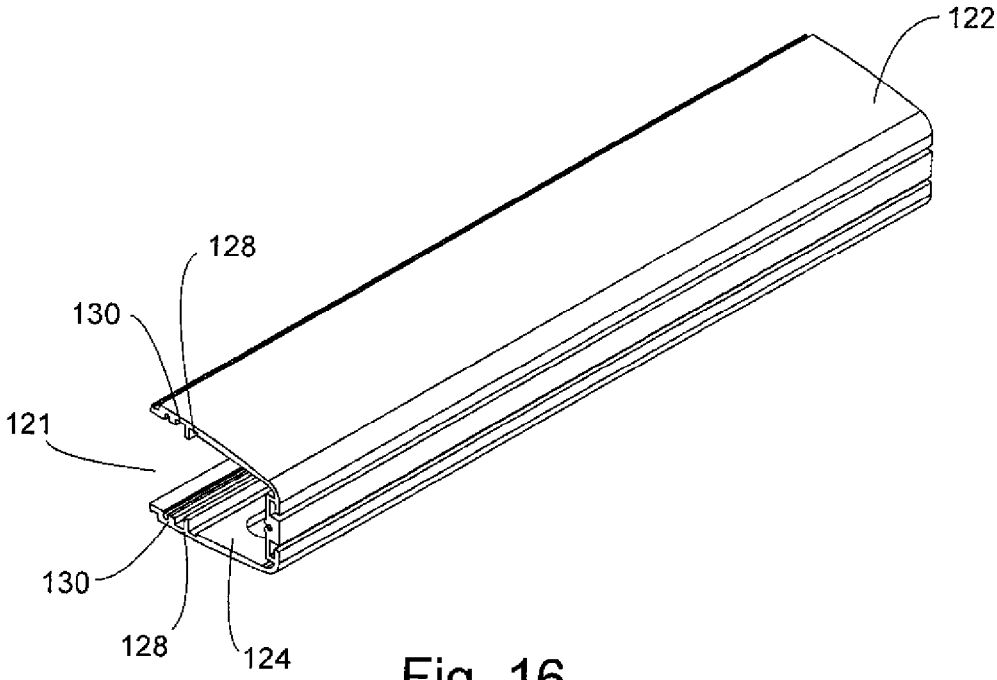
FIG. 16 is a rear, perspective view of the channel support.
Figure 17:
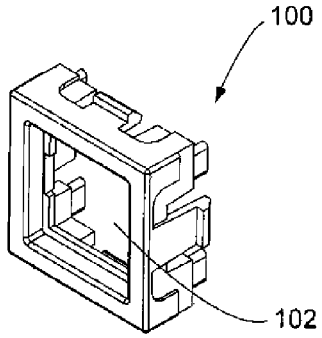
FIG. 17 is a front, perspective view of the receptacle housing shown in FIG. 1.
Figure 18:
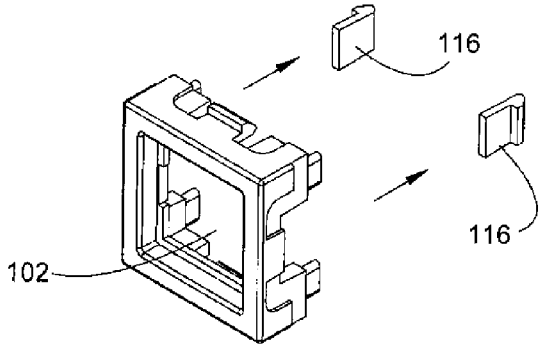
FIG. 18 is a perspective and partially exploded view of the receptacle housing shown in FIG. 17, and showing the relative positioning of the removable side latch tabs.
Figure 19:
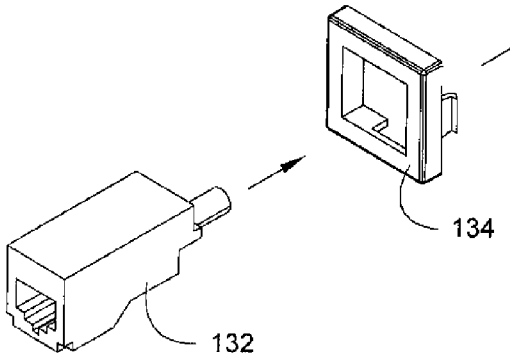
FIG. 19 is an exploded view of the receptacle housing shown in FIG. 17, and showing the main body of the receptacle housing consisting of the housing shell, a data port insert and a data port connector, thereby forming a data port assembly.
Figure 20:
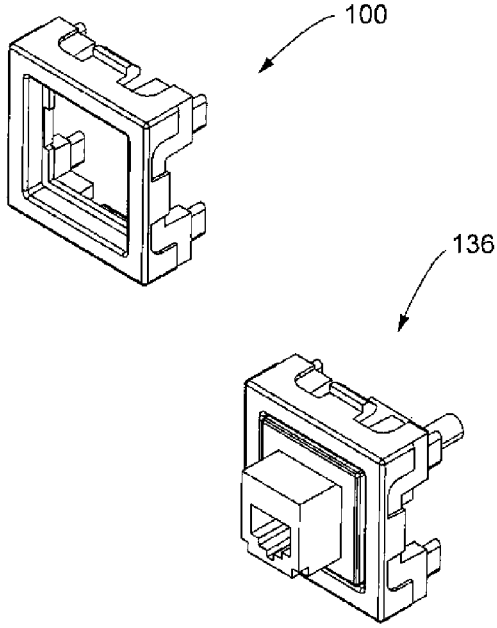
FIG. 20 is a perspective view of the data port assembly shown in FIG. 19, but shown in a fully assembled state.
Figure 21:
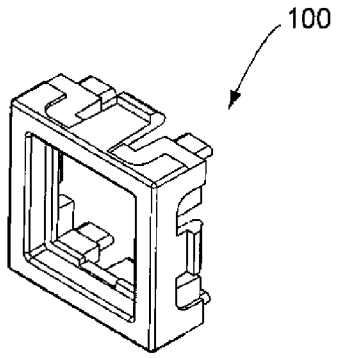
FIG. 21 is a perspective view of a receptacle housing for a simplex receptacle.

More specifically, FIG. 9 illustrates a rear, elevation view of the channel support 120. FIG. 10 illustrates a plan view of the support 120, while FIG. 11 illustrates a left-side end view of the support 120. FIG. 12 illustrates a front, elevation view of the channel support 120, while FIG. 13 illustrates a right-side end view of the support 120. FIG. 14 illustrates an underside view of the support 120. FIG. 15 illustrates a front, perspective view of the support 120, while FIG. 16 illustrates a rear, perspective view of the support 120. The channel support 120 includes an elongated channel 121 formed between a pair of opposing sides 122. The opposing sides 122 have inner side surfaces 124. The sides 122 are integral with or otherwise connected together with a floor section 126. At the upper portions of each of the inner side surfaces 124 is a longitudinally extending rib 128. Positioned immediately above the ribs 128 are a set of opposing upper channels 130.

As previously described with respect to FIGS. 1-8, the invention provides for what can be characterized a receptacle housing 100. In fact, this housing 100 is capable of being utilized for various electrical elements, in addition to electrical receptacles. FIGS. 17-20 illustrate the use of the receptacle housing 100 with a data port connector 132 (FIG. 19) and data port insert 134 (also FIG. 19). The data port insert 134 can be received within the opening 102 of the housing 100, and secured to the housing 100 by means tabs that extend from the sides of data port insert 134. The data port insert 134 is sized so as to appropriately receive the data port connector 132. The resultant component is the data port assembly 136 shown in FIG. 20.

Figure 22:
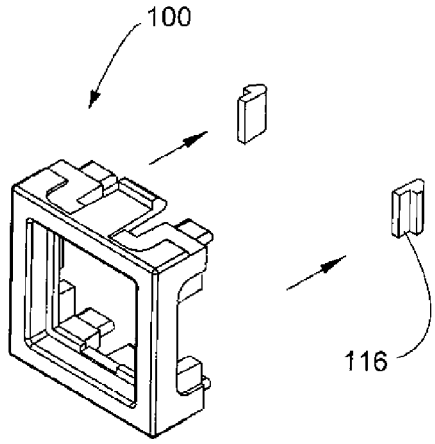
FIG. 22 is a partially exploded and perspective view, showing the removable side latch tabs and the housing shell.
Figure 23:
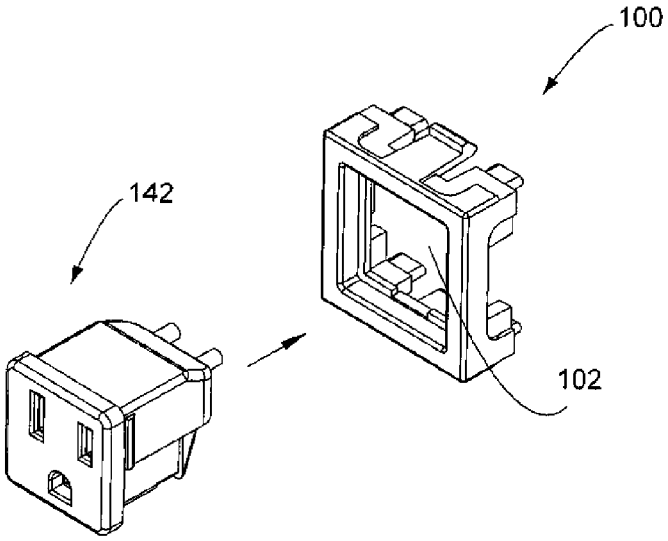
FIG. 23 is a perspective and exploded view showing the receptacle housing with a simplex receptacle.
Figure 24:
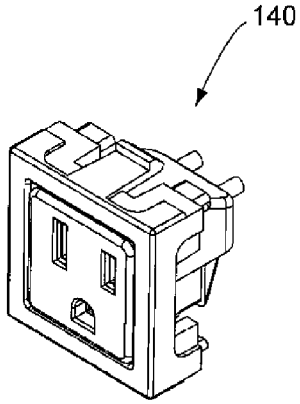
FIG. 24 is a perspective view of the fully assembled simplex receptacle assembly.
Figure 25:
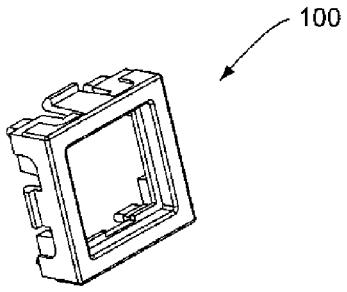
FIG. 25 is a perspective view of the receptacle housing shown in FIG. 1.
Figure 26:
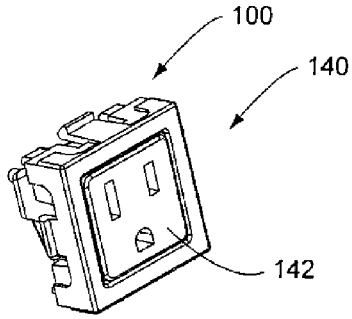
FIG. 26 is a perspective view of the simplex receptacle assembly shown in FIG. 24.

The housing 100 can also be used for other components, such as simplex receptacles. A simplex receptacle assembly 140 is shown in FIGS. 21-24. FIG. 24 shows a fully assembled simplex receptacle assembly. FIG, 21 shows the receptacle housing 100 previously described herein, and FIG. 22 shows the housing 100 with the removable tabs 116. FIG. 23 illustrates an exploded view showing the receptacle housing 100, with a simplex receptacle 142 positioned so as to be received within the opening 102. In this particular instance, an insert is not required, since the opening 102 is originally sized so as to receive the receptacle 142.

Figure 27:
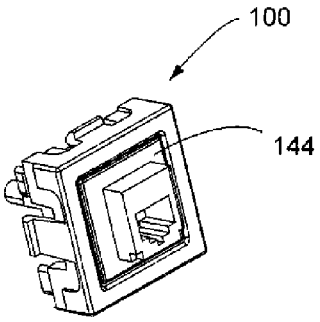
FIG. 27 is a perspective view illustrating the use of the receptacle assembly with a data port.
Figure 28:
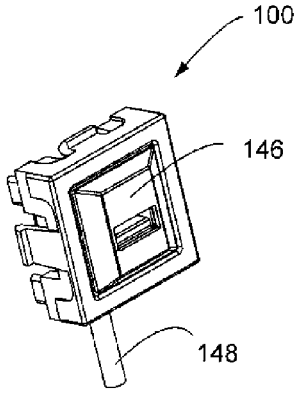
FIG. 28 illustrates the use of the housing in a perspective view with a USB port and corresponding cable.

FIGS. 25-30 show other components which can be utilized with the adapter assembly in accordance with the invention. FIG. 25 again illustrates the housing 100, while FIG. 26 again shows the simplex receptacle assembly 140, with the receptacle 142 itself. FIG. 27 illustrates the use of the receptacle housing 100 with a data port 144. The data port 144 may or may not require an insert for the opening 102. FIG. 28 illustrates the use of the housing 100 with a USB port 146, and corresponding cable 148. Again, an insert may or may not be required.

Figure 29:
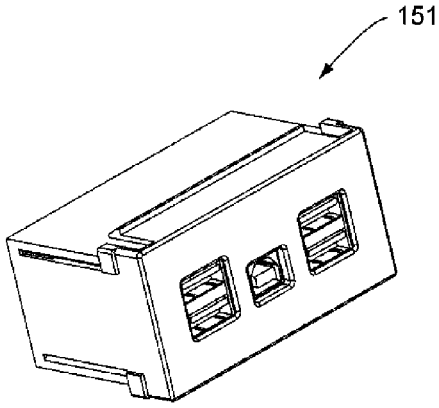
FIG. 29 illustrates a data port housing which may be utilized with an adapter assembly in accordance with the invention.
Figure 30:
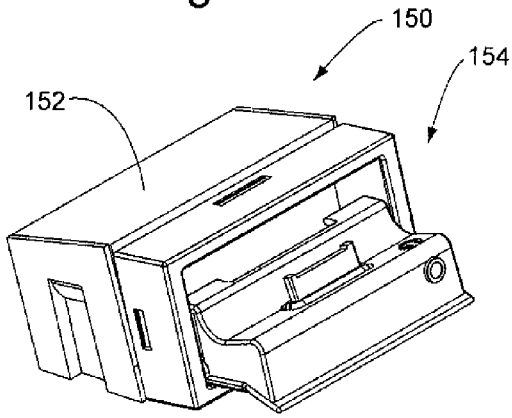
FIG. 30 illustrates a docking station in an open configuration, showing the docking station components.

FIG. 29 illustrates a data port housing 151 which maybe used with the adapter assembly in accordance with the invention. FIG. 30 illustrates a docking station 150 in an open state, and showing the docking station components 154. The docking station 150 is disclosed in commonly owned U.S. patent application Ser. No. 61/131,403 filed Jun. 9, 2008, and titled "DOCKING STATION WITH POWER AND DATA CENTER."

Figure 31:
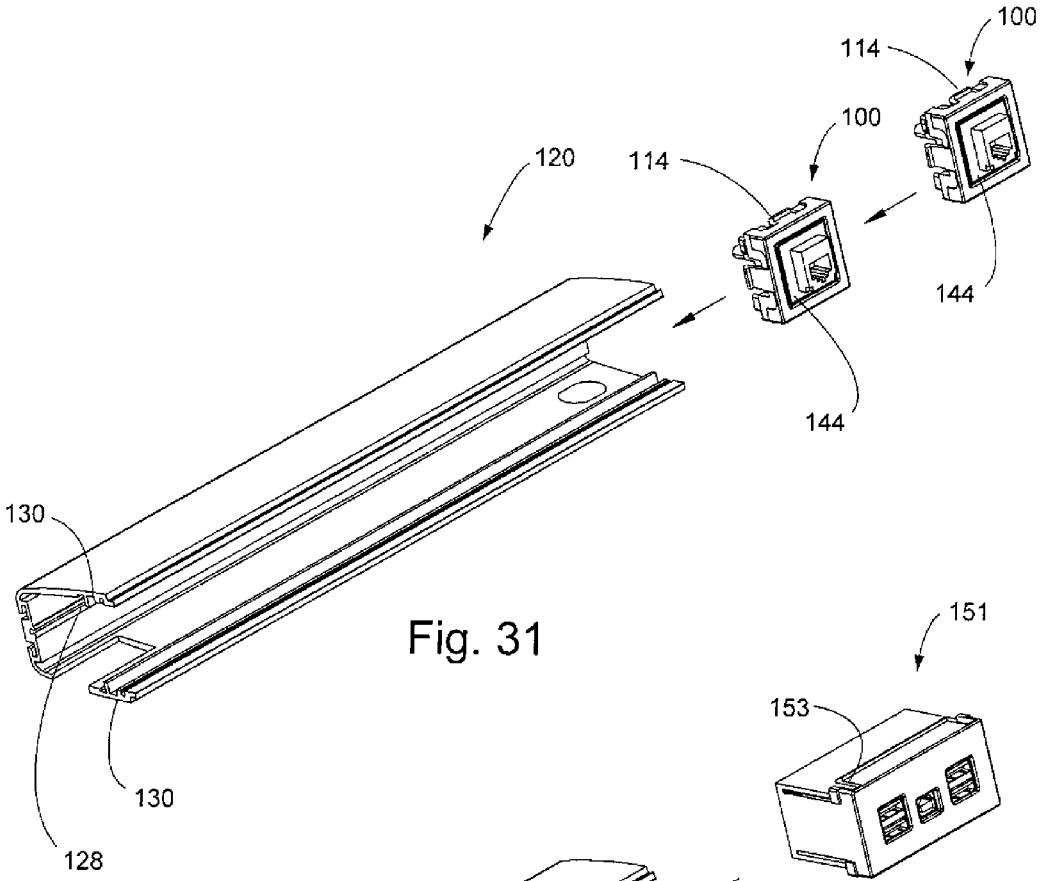
FIG. 31 is a perspective and partially exploded view showing two of the data port assemblies as they are positioned so as to be received within the channel support.
Figure 32:
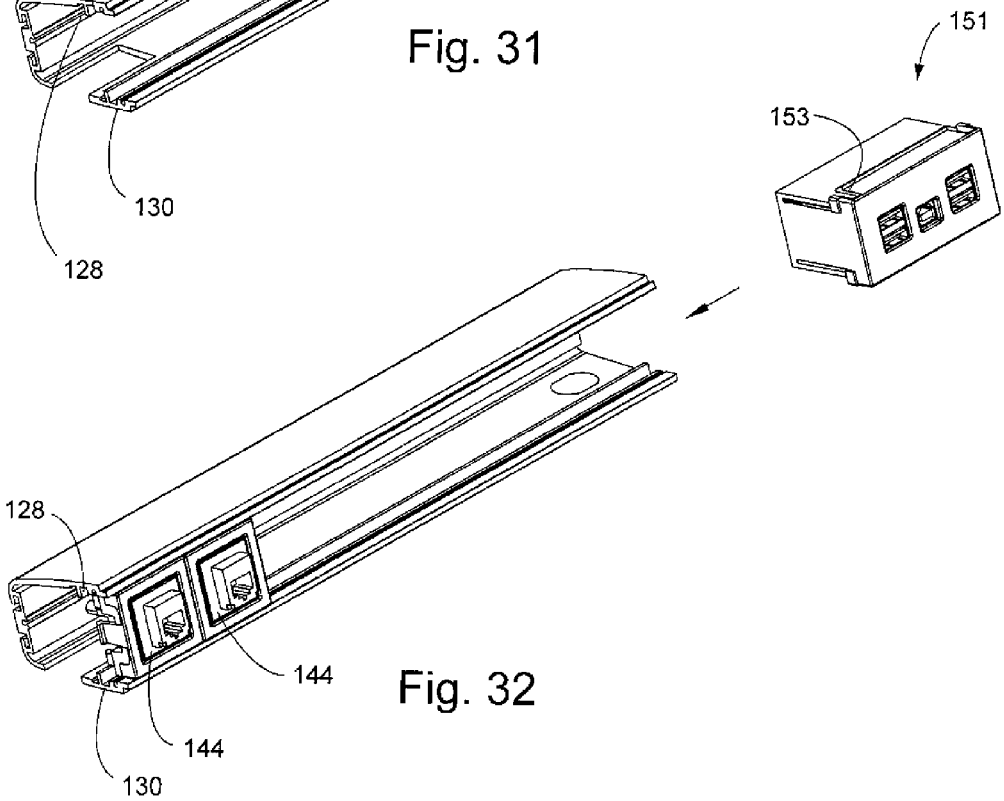
FIG. 32 illustrates a further data port assembly which may be utilized and received within the channel support.

FIGS. 31 and 32 illustrate the manner in which certain electrical elements can be received within the channel support 120. Specifically, FIG. 31 illustrates the positioning of a pair of receptacle housings 100 with data ports 144 as they can be slidably received within the channel support 120. FIG. 32 shows the data ports 144 within the channel support 120. With this configuration, the latch tabs 114 on opposing sides of the housings 100 are received within the upper channels 130 of the channel support 120. FIG, 32 also shows the relative positioning of a data port housing assembly 151 as it is ready to be received within the channel support 120. The data port assembly housing 151 includes a pair of elongated and resilient latches 153 which are also received within the upper channels 130.

Figure 33:
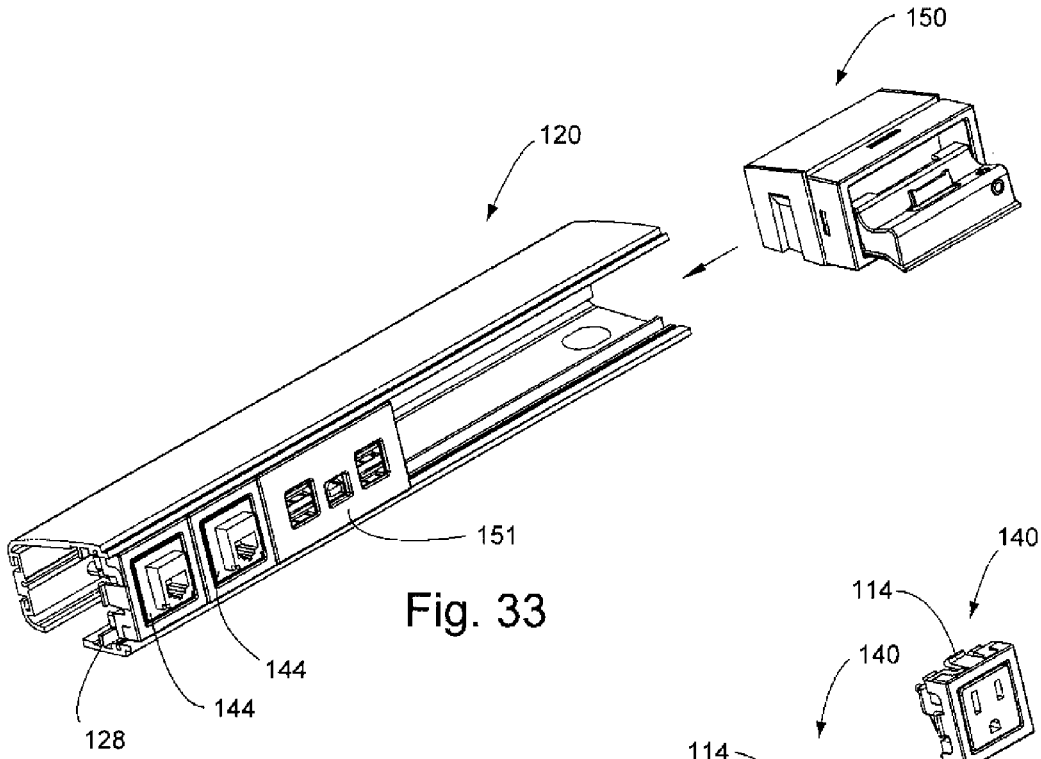
FIG. 33 illustrates the relative positioning of the docking station so as to be receivable within the channel support.

FIG. 33 is similar to FIG. 32, but illustrates the positioning of the docking station 150 so as to be received within the channel support 120. The docking station 150 can be positioned so as to slide between ribs 128 of the channel support 120.

Figure 34:
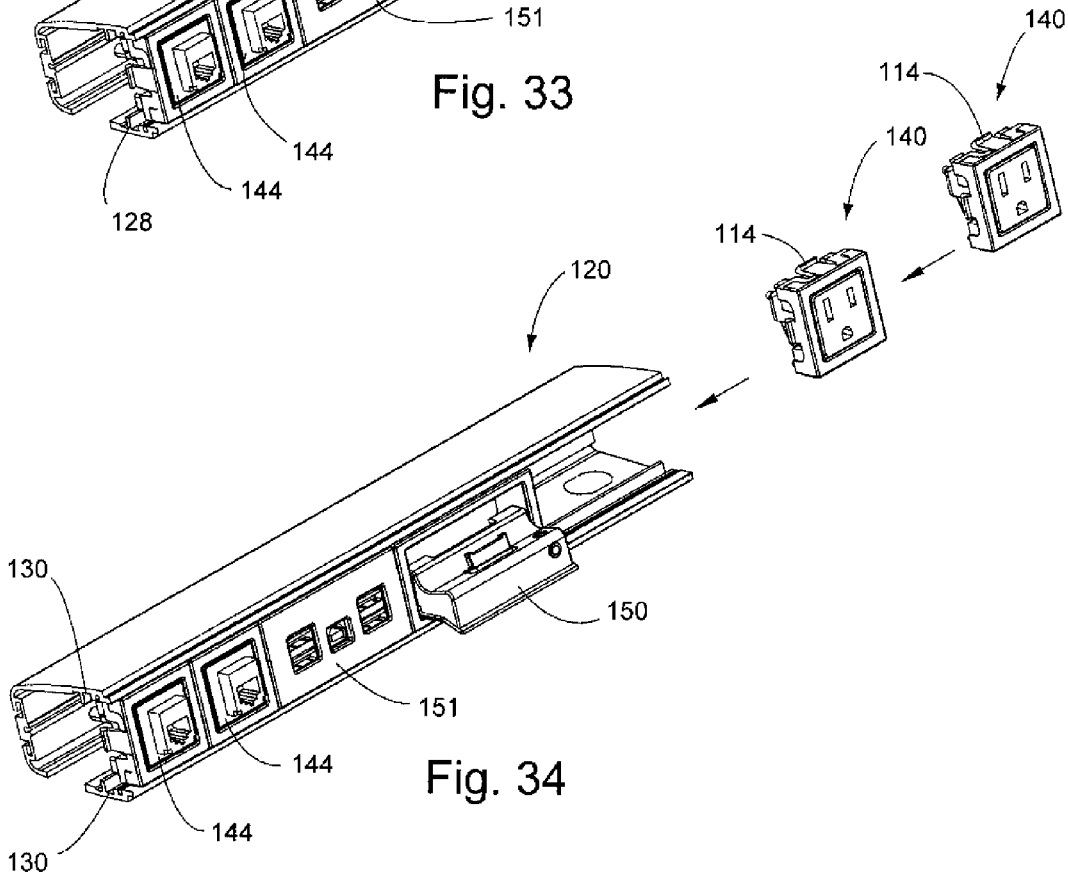
FIG. 34 is a perspective view showing the relative positioning of two of the receptacle assemblies positioned so as to be received within the channel support.

FIG. 34 shows relative positioning of a pair of simplex receptacle assemblies 140, for reception within the channel support 120. Again, the latch tabs 114 will be received within the upper channels 130.

Figure 35:
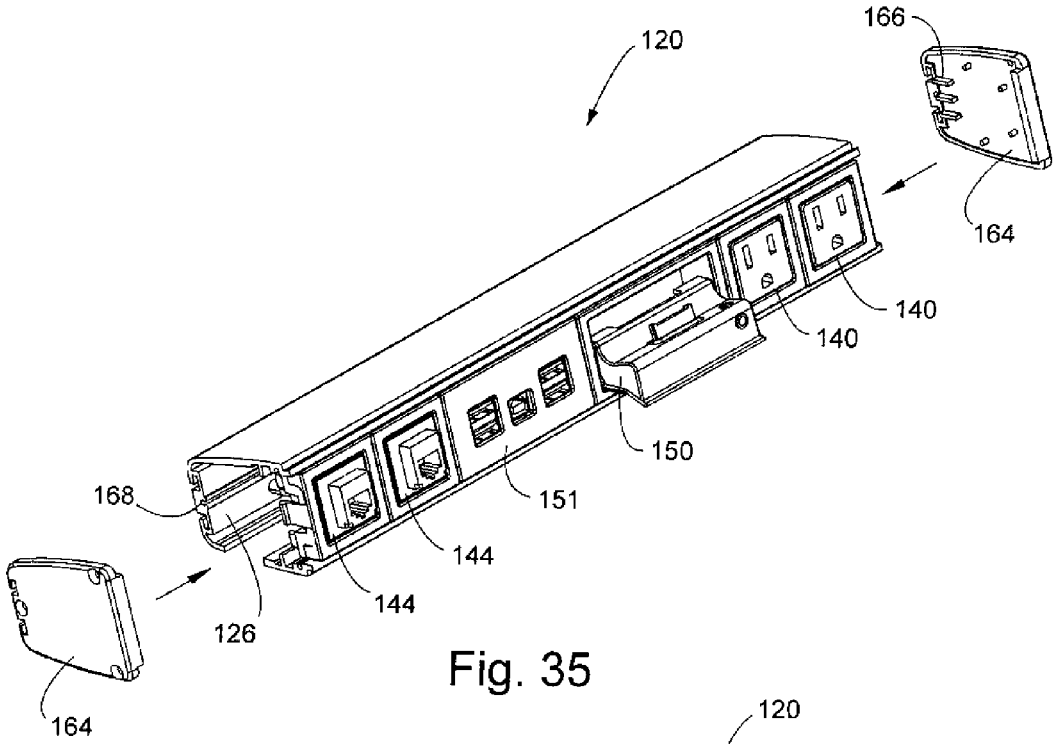
FIG. 35 illustrates a perspective view of the channel support with two of the data port assemblies, data port housing, docking station and two simplex receptacle assemblies, and also shows a relative positioning of a pair of side covers which can be releasably secured to the channel support.
Figure 36:
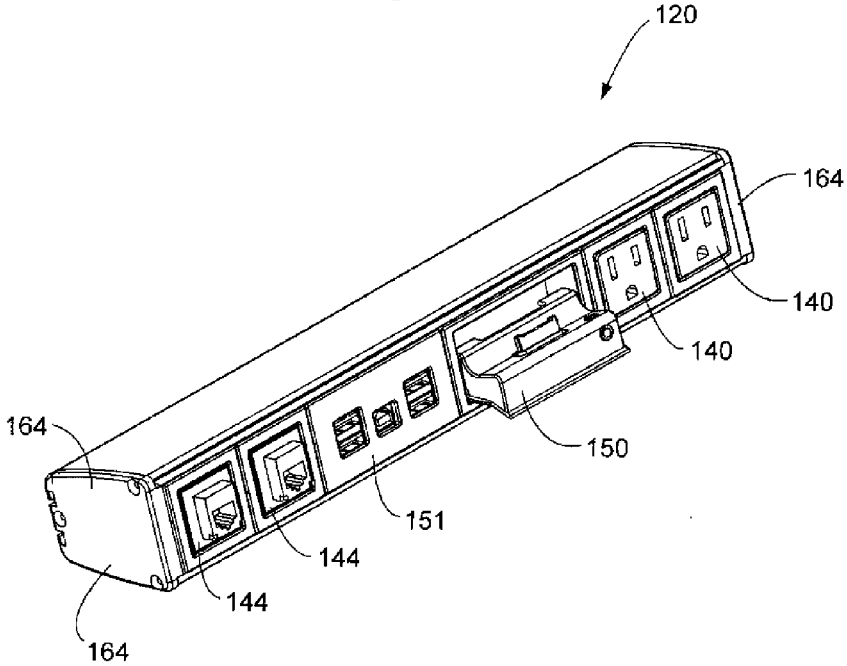
FIG. 36 illustrates a perspective view of the fully assembled channel support and side covers.

FIGS. 35 and 36 illustrate the channel support 120 fully assembled with the pair of data ports 144, data port assembly 151, data station 150, and the pair of simplex receptacle assemblies 140. FIGS. 35 and 36 also show (with FIG. 35 shown in exploded view) the relative position of a pair of side covers 164 which can be releasably secured to the channel support 120. The inner surfaces of the side covers 164 include sets of ribs 166. The ribs 166 cooperatively are received within channels 168 located within the floor section 126 of the channel support 120.

Figure 37:
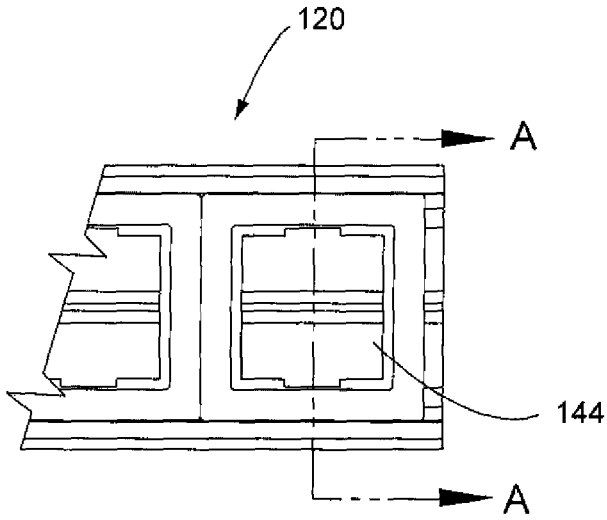
FIG. 37 shows a portion of a data port as received within a portion of the channel support.
Figure 38:
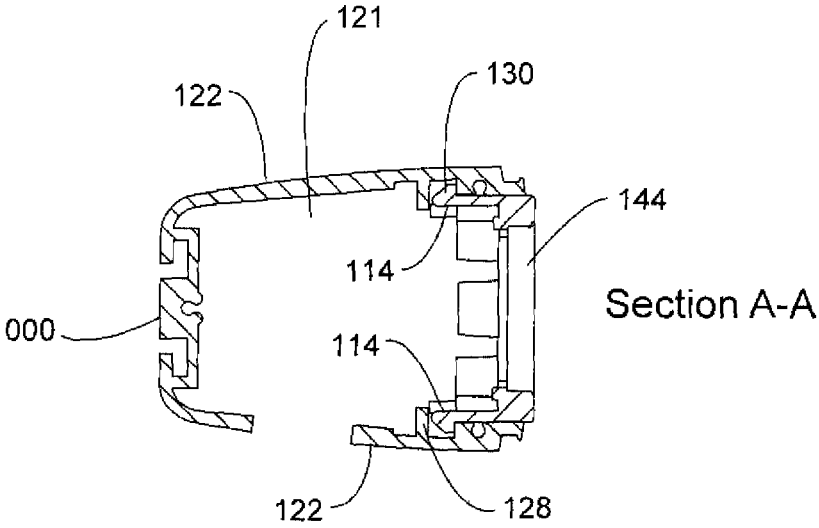
FIG. 38 is a sectional view, taken along section lines 38-38 of FIG. 37.

FIG. 37 shows a portion of a data port 144 as received within a portion of the channel support 120. FIG. 38 is a. sectional view, taken along section lines 38-38 of FIG. 37. Specifically, FIG. 38 shows how the data port 144 is coupled to the channel support 120, through the latch tabs 114 being received within the channels 130. Also shown are the ribs 128.

Figure 39:
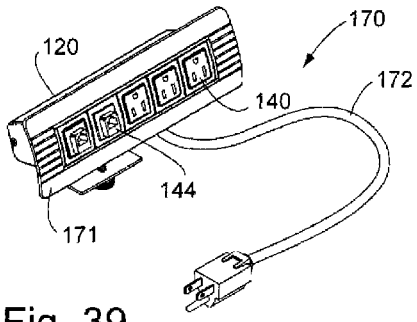
FIG. 39 is a perspective view of an assembled power and data assembly, having a cord, with three simplex receptacle assemblies and two data port assemblies.

FIGS. 39-43 are perspective views showing various illustrations of various electrical assemblies utilizing the power and data adapter assembly in accordance with the invention, which incorporates the channel support 120. FIG. 39 is a perspective view of a power and data. assembly 170, with a cord 172. The assembly 170 uses the channel support 120 and a cover plate 171. The assembly in FIG. 39 includes a pair of data ports 144 and three simplex receptacle assemblies 140.

Figure 40:
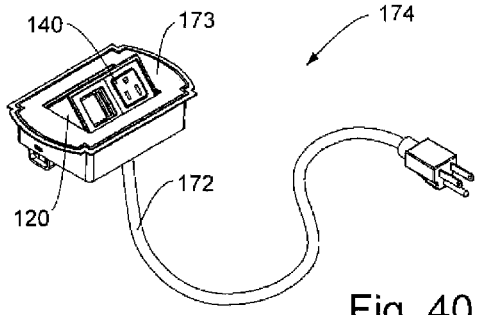
FIG. 40 is a view of another type of power and data assembly, showing a single simplex receptacle assembly.

Power and data assembly 174 shown in FIG. 40 includes a cord 172, with the channel 120 being received within a power and data housing 173. The assembly includes a single simplex receptacle assembly 140.

Figure 41:
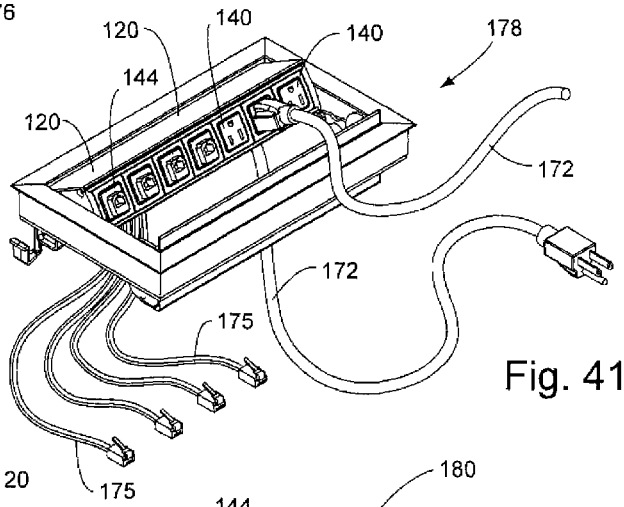
FIG. 41 is a further perspective view of another power and data port assembly, showing use of a channel support with a set of four data port housings and three simplex receptacle assemblies.

FIG. 41 illustrates a further power and data assembly 178. This power and data assembly 178 includes four data ports 144 and three simplex receptacle assemblies 140. Cords 172 and data cables 175 are also shown.

Figure 42:
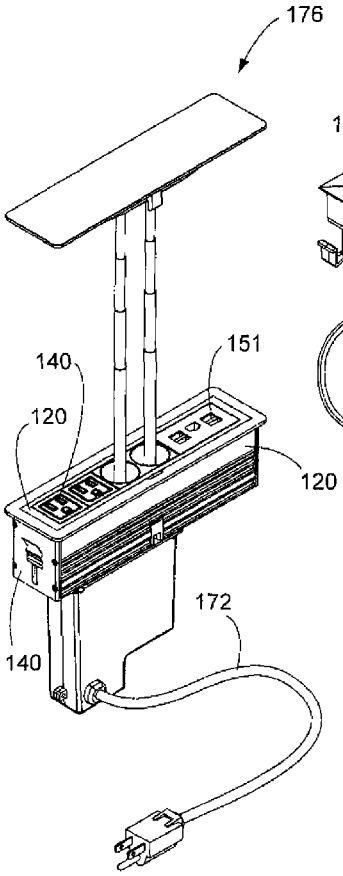
FIG. 42 shows the use of a channel support housing to simplex receptacle assemblies and a data port housing and utilized with a retractable light assembly.
Figure 43:
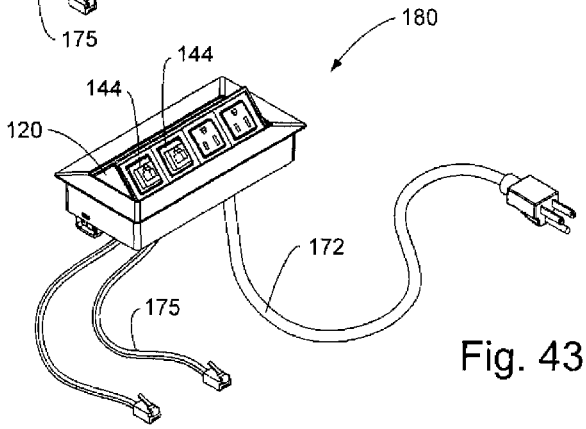
FIG. 43 illustrates a further power and data assembly in perspective view, using a channel support, with a pair of data port assemblies and a pair of simplex receptacle assemblies.

FIG. 42 illustrates the use of a channel support 120 with a pair of simplex receptacle assemblies 140, data port housing 151, and a retractable light assembly 176. Still further, FIG. 43 illustrates a further power and data assembly 180, using a channel support 120, with a pair of data ports 144 and a pair of simplex receptacle assemblies 140.

It will be apparent to those skilled in the pertinent arts that other embodiments of the power and data adapter assemblies in accordance with the invention can be designed. That is, the principles of the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

The invention claimed is:

1. A power and data adapter assembly comprising:

an elongate and generally C-shaped channel support having a pair of opposing sides and opposite ends, said opposing sides extending longitudinally between said opposite ends and defining a longitudinal elongated channel between respective inner surfaces of said opposing sides;

a respective channel mounting element formed longitudinally along said inner surface of each of said opposing sides and extending along the length of said channel support between said opposite ends;

a plurality of housings having upper and lower housing sides with respective first latch elements, and opposite housing sides with respective second latch elements, said upper and lower housing sides and said opposite housing sides of each of said housings cooperating, to define an opening therein, each of said housings configured to interchangeably receive, between said opposite housing sides and said upper and lower housing sides, at least two different types of electrical components, whereby a portion of the electrical component is accessible via said opening;

wherein said first latch elements are configured to slidably engage respective ones of said channel mounting elements of said channel support when said housings are positioned at a first rotational orientation relative to said channel support, and said second latch elements are configured to slidably engage respective ones of said channel mounting elements of said channel support when said housings are positioned at a second rotational orientation that is rotated about 90 degrees from the first rotational orientation; and wherein said housings are each longitudinally, sequentially, and interchangeably slidable into said longitudinal channel defined by said channel support, when said housings are in either of the first and second rotational orientations.

2. The power and data adapter assembly of claim 1, wherein when either of said first or second latch elements are mated with said channel mounting elements, said housings are removable from said channel support only via sliding movement of said housings outwardly through an open one of said opposite ends of said elongated channel.

3. The power and data adapter assembly of claim 1, wherein said housings comprise receptacle housings and said electrical components comprise simplex receptacles.

4. The power and data adapter assembly of claim 1, wherein said housings comprise data port housings, and said electrical components comprise data port connectors and data ports.

5. The power and data adapter assembly of claim 1, wherein said opening is configured to receive an outlet receptacle and said housings comprise:

a main body having a front cover, said front cover having a face and a pair of sides; and a pair of latch tabs positioned at upper and lower sides of said front cover.

6. The power and data adapter assembly of claim 5, wherein said second latch elements comprise side latch tabs positioned on opposing sides of said front cover.

7. The power and data adapter assembly of claim 1, wherein said channel mounting elements comprise longitudinally-extending ribs and opposing channel slots.

8. The power and data adapter assembly of claim 1, wherein each of said opposite ends of said channel support comprises an open end, said assembly further comprising a removable end cap coupled to each of said opposite ends of said channel support, wherein each of said removable end caps is configured to prevent said housings from sliding out of engagement with said tracks at a respective one of said opposite ends.

9. The power and data adapter assembly of claim 1, wherein said first latch elements or said second latch elements comprise removable latch tabs.

10. The power and data adapter assembly of claim 1, further comprising at least one chosen from (i) a data port housing assembly having a pair of elongated and resilient latches configured to slidably engage said channel mounting elements, and (ii) a docking station configured to slidably engage said channel mounting elements.

11. A power and data adapter assembly comprising:

an elongate and generally C-shaped channel support having a substantially constant cross section and a pair of opposing sides and opposite ends, said opposing sides extending longitudinally between said opposite ends and defining a longitudinal elongated channel between respective inner surfaces of said opposing sides;

a track formed longitudinally along said inner surface of each of said opposing sides, and extending along the length of said channel support between said opposite ends;

a plurality of housings having opposite housing sides with respective latch elements, each of said housings configured to interchangeably receive at least two different types of electrical components between said opposite housing sides, wherein said latch elements are configured to slidably engage respective ones of said tracks of said channel support; and wherein said housings are each individually, sequentially, and interchangeably slidable along said longitudinal channel, in either of at least two different rotational orientations, so that said plurality of housings are individually supported in side-by-side arrangement by said channel support.

12. The power and data adapter assembly of claim 11, wherein when said latch elements are mated with said channel mounting elements, said housings are removable from said channel support only via sliding movement of said housings outwardly through an open one of said opposite ends of said elongated channel.

13. The power and data adapter assembly of claim 11, wherein said housings comprise receptacle housings and said electrical components comprise simplex receptacles.

14. The power and data adapter assembly of claim 11, wherein said housings comprise data port housings, and said electrical components comprise data port connectors and data ports.

15. The power and data adapter assembly of claim 11, wherein said housings each comprise:

an opening configured to receive an outlet receptacle;

a main body having a front cover, said front cover having a face and a pair of sides; and a pair of latch tabs positioned at upper and lower sides of said front cover.

16. The power and data adapter assembly of claim 15, wherein said latch elements comprise respective side latch tabs positioned on opposing sides of said front cover of each of said housings.

17. The power and data adapter assembly of claim 11, wherein said tracks comprise longitudinally-extending ribs and opposing channel slots.

18. The power and data adapter assembly of claim 11, wherein each of said opposite ends of said channel support comprises an open end, said assembly further comprising an end cap coupled to each of said opposite ends of said channel support, wherein each of said end caps is configured to prevent said housings from sliding out of engagement with said tracks at a respective one of said opposite ends.

19. The power and data adapter assembly of claim 11, wherein said latch elements comprise removable latch tabs.

20. The power and data adapter assembly of claim 11, further comprising at least one chosen from (i) a data port housing assembly having a pair of elongated and resilient latches configured to slidably engage said channel mounting elements, and (ii) a docking station configured to slidably engage said channel mounting elements.

* * * * *